US008341762B2

(12) United States Patent
Balzano

(10) Patent No.: US 8,341,762 B2
(45) Date of Patent: Jan. 1, 2013

(54) SAFETY VEST ASSEMBLY INCLUDING A HIGH RELIABILITY COMMUNICATION SYSTEM

(76) Inventor: Alfiero Balzano, Garden Grove, CA (US)

( * ) Notice: Subject to any disclaimer, the term of this patent is extended or adjusted under 35 U.S.C. 154(b) by 1321 days.

(21) Appl. No.: 12/077,841

(22) Filed: Mar. 21, 2008

(65) Prior Publication Data

US 2012/0174299 A1 Jul. 12, 2012

(51) Int. Cl.
*A41D 1/04* (2006.01)
*F41H 1/02* (2006.01)
*F41H 1/00* (2006.01)

(52) U.S. Cl. ..... 2/2.5; 2/2.11; 2/2.14; 2/102

(58) Field of Classification Search ..... 2/102, 2.11, 2/2.14, 272, 900, 905, 2.5
See application file for complete search history.

(56) References Cited

U.S. PATENT DOCUMENTS 3,843,969 A * 10/1974 George et al. ..... 2/2.5
4,572,197 A * 2/1986 Moore et al. ..... 600/389
4,580,572 A * 4/1986 Granek et al. ..... 600/388
4,729,377 A * 3/1988 Granek et al. ..... 600/393
4,876,724 A * 10/1989 Suzuki ..... 381/385
5,005,213 A * 4/1991 Hanson et al. ..... 398/119
5,281,957 A * 1/1994 Schoolman ..... 345/8
5,285,398 A * 2/1994 Janik ..... 361/679.03
5,316,830 A * 5/1994 Adams et al. ..... 428/195.1
5,416,310 A * 5/1995 Little ..... 235/462.44
5,491,651 A * 2/1996 Janik ..... 361/679.03
5,515,070 A * 5/1996 Kawada ..... 345/8
5,555,490 A * 9/1996 Carroll ..... 361/679.03
5,572,401 A * 11/1996 Carroll ..... 361/679.03
5,581,492 A * 12/1996 Janik ..... 361/679.03
5,636,378 A * 6/1997 Griffith ..... 2/455
5,694,645 A * 12/1997 Triplette ..... 2/102
5,774,338 A * 6/1998 Wessling, III ..... 361/730
5,798,907 A * 8/1998 Janik ..... 361/679.03
6,249,427 B1 * 6/2001 Carroll ..... 361/679.03
6,359,786 B1 * 3/2002 Bianco ..... 361/730
6,389,499 B1 * 5/2002 Frank et al. ..... 710/300
6,507,486 B2 * 1/2003 Peterson, III ..... 361/679.03
6,529,372 B1 * 3/2003 Ng et al. ..... 361/679.03
6,687,523 B1 * 2/2004 Jayaramen et al. ..... 600/388
6,727,197 B1 * 4/2004 Wilson et al. ..... 442/301
6,895,261 B1 * 5/2005 Palamides ..... 455/575.6
6,915,668 B2 * 7/2005 Huang et al. ..... 66/171
7,064,299 B2 * 6/2006 Green et al. ..... 219/515
7,116,940 B2 * 10/2006 Dvorak ..... 455/66.1
7,138,612 B2 * 11/2006 Green et al. ..... 219/515
7,144,830 B2 * 12/2006 Hill et al. ..... 442/205
7,173,437 B2 * 2/2007 Hervieux et al. ..... 324/663

(Continued)

*Primary Examiner* — Bobby Muromoto, Jr.
(74) *Attorney, Agent, or Firm* — Stetina Brunda Garred & Brucker

(57) ABSTRACT

There is provided a safety vest assembly including a vest having a vest outer layer defining a vest inner cavity. A pair of contact substrates is disposed within the vest inner cavity. Each contact substrate includes an input connection element. A data input is connected to a respective contact substrate. The data input is electrically connected to the respective input connection element and is configured to receive data from the wearer. A data output is connected to a respective contact substrates and is communicable with a remote transceiver. The data output is electrically connected to the respective input connection element and is configured to communicate data to the remote transceiver. An input flex circuit is engageable with the pair of input connection elements to facilitate communication between the data input and data output along the input flex circuit.

16 Claims, 2 Drawing Sheets

U.S. PATENT DOCUMENTS

| | | | | |
|---|---|---|---|---|
| 7,202,815 | B2 * | 4/2007 | Swope et al. | 342/427 |
| 7,291,014 | B2 * | 11/2007 | Chung et al. | 434/11 |
| 7,299,964 | B2 * | 11/2007 | Jayaraman et al. | 228/110.1 |
| 7,308,294 | B2 * | 12/2007 | Hassonjee et al. | 600/386 |
| 7,377,835 | B2 * | 5/2008 | Parkulo et al. | 455/521 |
| 7,398,097 | B2 * | 7/2008 | Parkulo | 455/521 |
| 7,428,772 | B2 * | 9/2008 | Rock | 28/159 |
| 7,447,534 | B1 * | 11/2008 | Kingsley et al. | 600/372 |
| 7,474,910 | B2 * | 1/2009 | Hassonjee et al. | 600/395 |
| 7,576,679 | B1 * | 8/2009 | Orr et al. | 342/20 |
| 7,592,276 | B2 * | 9/2009 | Hill et al. | 442/301 |
| 7,658,612 | B2 * | 2/2010 | Lee et al. | 439/37 |
| 7,764,185 | B1 * | 7/2010 | Manz et al. | 340/601 |
| 7,769,412 | B1 * | 8/2010 | Gailloux | 455/569.1 |
| 7,804,440 | B1 * | 9/2010 | Orr | 342/20 |
| 7,805,767 | B2 * | 10/2010 | McElroy et al. | 2/2.5 |
| 7,822,299 | B2 * | 10/2010 | Borgos et al. | 385/12 |
| 7,849,888 | B2 * | 12/2010 | Karayianni et al. | 139/426 R |
| 7,870,761 | B2 * | 1/2011 | Valentine et al. | 66/171 |
| 7,966,052 | B2 * | 6/2011 | DeFusco et al. | 600/386 |
| 7,970,451 | B2 * | 6/2011 | Hassonjee et al. | 600/395 |
| 7,996,056 | B2 * | 8/2011 | Rowlandson et al. | 600/386 |
| 8,033,996 | B2 * | 10/2011 | Behar | 600/300 |
| 8,060,175 | B2 * | 11/2011 | Rowlandson et al. | 600/382 |
| 8,099,794 | B2 * | 1/2012 | Carstens | 2/16 |
| 8,127,440 | B2 * | 3/2012 | Douglas | 29/846 |

* cited by examiner

SAFETY VEST ASSEMBLY INCLUDING A HIGH RELIABILITY COMMUNICATION SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to a protective vest, and more particularly, to a safety vest assembly having a communication system integrated therein for facilitating communication between the safety vest assembly and a remote transceiver.

It is well known that individuals participating in high risk activities may employ the use of protective clothing to mitigate injury. For instance, police officers and soldiers may wear bulletproof vests, firefighters and oil rig operators may wear fireproof vests, and people working in extremely cold environments may wear clothing to protect them from the extreme temperatures. Furthermore, because of the risk of injury associated with such high risk activities, it may desirable to maintain communication with those individuals in order to know their condition, location or status of completing a project. For example, it may be useful to communicate with a soldier patrolling a hostile environment or a fire fighter located in a burning building.

Communication with individuals located in such extreme conditions has typically been by way of walkie-talkies or telephones. In other words, the individual was generally required to carry a communication device while performing their activity. In many cases, the individual may lose the communication device or damage the communication device by in the course of conducting the high risk activity. Furthermore, individuals are oftentimes required to carry other tools or self-defense items, thereby making it very difficult or impossible to carry the communication device.

Some individuals wore a holster to carry the communication device while performing their activity. However, the added bulk of the walkie-talkie or telephone may inhibit the movement of the individual. In addition, the walkie-talkie or telephone may be exposed while the wearer is performing the high risk activity thereby making the walkie-talkie or telephone vulnerable to failure.

As is apparent from the foregoing, there exists a need in the art for a communication device that may be integrated into a user's protective clothing. The present invention addresses this particular need, as will be described in more detail below.

BRIEF SUMMARY

There is provided a safety vest assembly fitted for use by a wearer. The safety vest assembly includes a vest having a vest outer layer defining a vest inner cavity. A pair of contact substrates is disposed within the vest inner cavity. Each contact substrate includes an input connection element. A data input is connected to a respective one of the pair of contact substrates. The data input is electrically connected to the respective input connection element and is configured to receive data from the wearer. A data output is connected to a respective one of the pair of contact substrates and is communicable with a remote transceiver. The data output is electrically connected to the respective input connection element and is configured to communicate data entered by the wearer to the remote transceiver. An input flex circuit is also disposed within the vest inner cavity. The input flex circuit includes a pair of circuit connection portions that are engageable with respective ones of the pair of input connection elements to facilitate communication between the data input and data output along the input flex circuit. A pair of securement elements secure the input flex circuit to the data input and data output.

The safety vest assembly may also be capable of facilitating communication from the remote transceiver to the vest. In this manner, the safety vest assembly may include a receiver connected to a contact substrate. The receiver may be electrically connected to the respective input connection element on the contact substrate. The receiver may be communicable with the remote transceiver to receive data therefrom. The safety vest assembly may also include a receiver output element connected to a contact substrate. The receiver output element may be electrically connected to the respective input connection element. The receiver output element may be configured to communicate data received from the remote transceiver to the user.

The safety vest assembly may provide an integrated communication system into a protective safety vest to simplify communication between the individual wearing the vest and a remote transceiver. The safety vest assembly may also eliminate the bulk that was previously associated with carrying traditional communication devices such as walkie-talkies and telephones. The integration of the communication components into the safety vest may enhance the durability of the communication components.

It is contemplated that the vest may be a bullet resistant vest having a bullet protection layer configured to mitigate bullet penetration through the vest. The bullet protection layer may be disposed within the vest inner cavity. The vest may also be a fire resistant vest comprised of fire resistant material.

The data input may include a key pad and/or a microphone to enable various forms of communication between the individual wearing the vest and the remote transceiver. The safety vest assembly may include a data switch connected to the data output to allow a user to switch between data from the key pad and data from the microphone. An encryption device may also be in communication with the data output to encrypt communications transmitted therefrom.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
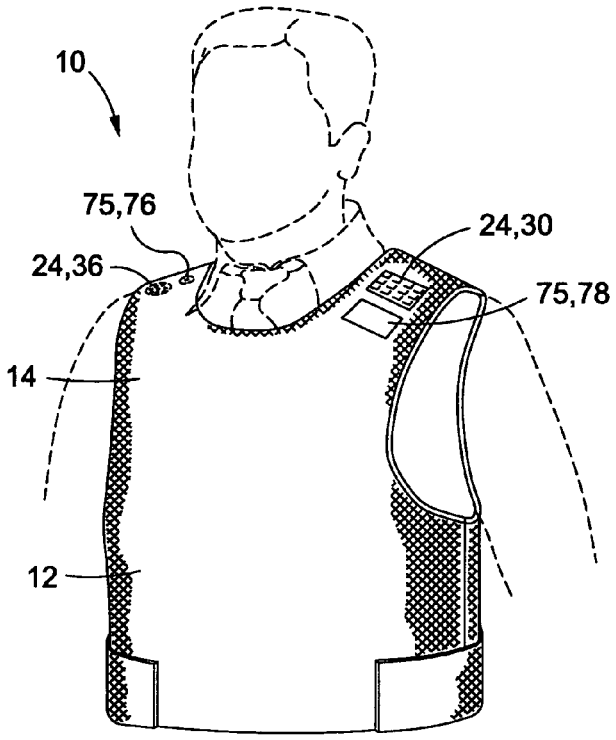
FIG. 1 is a perspective view of a safety vest assembly having a flex circuit disposed within a vest, the flex circuit extending between a data input and data output.

Referring now to the drawings wherein the showings are for purposes of illustrating a preferred embodiment of the present invention only, and not for purposes of limiting the same, there is shown a safety vest assembly 10 constructed in accordance with an embodiment of the present invention. The safety vest assembly 10 includes a communication system integrated into an article of clothing, such as a vest 12, to allow the wearer to communicate with a remote transceiver 36. In this manner, various aspects of the invention simplify communication between a wearer and the remote transceiver 36.

Referring now to the embodiment illustrated in FIG. 1, the safety vest assembly 10 includes a vest 12 disposed on a wearer (shown in phantom). Although the embodiment shown in FIG. 1 includes a vest 12, it is understood that the safety vest assembly 10 may be incorporated into any article of clothing, including, but not limited to, jackets, shirts, pants, shorts, etc. The clothing may also include conventional suits and jackets which may be worn by security personnel to enable communication between the security teams. The vest 12 shown in FIG. 1 includes a vest outer layer 14 defining a vest cavity 16. The vest outer layer 14 may be comprised of a woven fabric material, a fluid-impermeable material, a fire-resistant material, or other materials that may be desirable. Furthermore, the vest outer layer 14 may include a color scheme, such as camouflage, as desired by a user.

According to one embodiment, the communication system incorporated into the vest 12 includes a data input 24 connected to the vest outer layer 14. It may be desirable for the data input 24 to be surface mounted on the vest outer layer 14 to provide a smooth, flush surface. The data input 24 is operative to receive data for transmission to a remote transceiver 36. In this regard, data may be entered by the wearer or gathered independent of wearer input.

It is contemplated that one of the easier ways to enter data into the communication system is by verbally communicating the data. This may be particularly true when the wearer is performing an activity that would make manual data entry very difficult. For instance, if the safety vest assembly 10 is being worn by a fire fighter holding a fire hose, the wearer may not be able to manually enter data. However, the fire fighter may want to communicate with a central dispatch to provide information as to the status of the fire, or whether additional help is needed. Therefore, according to one aspect of the invention, the data input 24 includes a microphone 32 to receive the verbal data. The microphone 32 may be may be a voice-activated to automatically turn on in response to the wearer entering verbal data (e.g., speaking). The microphone 32 may preferably be mounted near the top of the vest 12 near the wearer's mouth.

Although verbally entered data may be preferred in some circumstances, manually entered data may be preferred under alternate conditions. For instance, the wearer may be a soldier quietly conducting a search of enemy territory. Any noise may alert the enemy of the soldier's position. Therefore, one embodiment of the invention includes a data input 24 configured to allow the wearer to manually enter data into the communication system. In this manner, the data input 24 includes a user interface, such as a keypad 30, touch-screen, or other manual interface means. The user interface may be conveniently positioned on the vest 12 to enable a user to manually enter data therein. The keypad 30 may simply include basic input options, such as a button that may be pressed to indicate the wearer needs help, or that a mission has been accomplished. In other embodiments, the keypad 30 may be more sophisticated to enable more detailed communication.

Although verbally and manually entered data are discussed separately above, it is understood that a single safety vest assembly 10 may include a data input 24 configured to receive both verbally and manually entered data. As such, the data input 24 may include a combination of keypad 30, microphone 32, and/or other data entry devices that are known by those skilled in the art.

Although several embodiments of the data input 24 may be configured to receive manual and verbal input from a wearer, other embodiments of the data input 24 are configured to receive input independent of entry by the wearer. For instance, the data input 24 may include a GPS device 62 which generates a positioning signal including the wearer's location. Therefore, personnel monitoring the wearer may track the position of the wearer in real-time by receiving the GPS signal.

Furthermore, the data input 24 may include one or more physiological sensors 66 for monitoring the physiological condition of the wearer. For instance, the physiological sensor 66 may monitor the wearer's body temperature, heart rate, etc. In this manner, the physiological sensors 66 may be disposable adjacent the wearer or connectable to the wearer to monitor the wearer's physiological conditions.

In addition, the data input 24 may include one or more pressure sensors 64 to monitor pressure applied to the safety vest assembly 10. This may be desirable if the safety vest assembly 10 is worn by the wearer for protection against bullets or shrapnel. The pressure sensors 64 may detect the impact of a bullet or shrapnel against the safety vest assembly 10. This information may be communicated to a monitoring station to alert the monitors of the wearer's condition. The pressure sensors 64 may be disposed on the front, back, and/or side of the safety vest assembly in order to sufficiently detect impact with a foreign object, such as a bullet.

Once data is received from the data input 24, it is communicated to the remote transceiver 36 by a data output 34. The data output 34 may employ various wireless signal communication technologies known by those skilled in the art, including but not limited to, RF signals, Bluetooth®, infrared signals, and the like. As such, the data output 34 may include various components readily employed for signal transmission, such as amplifiers, signal converters. In one particular embodiment, the data output 34 is a radio system capable of transmitting the information via radio signals. The radio system may be configured to transmit the signals over a broad range of frequencies. In another embodiment, the data output 34 utilizes cell phone networks to transmit data to the remote transceiver 36. In this manner, the data output 34 may transmit the outgoing signal directly to the cell phone network, or the data output 34 may link-up with a conventional cell phone for signal transmission.

According to one particular implementation, the data input 24 and data output 34 are connectable to various external components to facilitate communication between the wearer and the remote location. For instance, the data input 24 may be connectable to an input element, such as full-sized keyboard to enable easier or more detailed data to be communicated to the remote transceiver 36. Alternatively, the input element may include an audio or video recorder that may be connected to the data input 24 to enable communication of audio and video data. In this manner, the data input 24 may include a data input port that is connectable to an input element. Likewise, the data output 34 may include a data output port connectable to a data output element such as a radio, amplifier, cell phone, or other communication element configured to transmit the signal to the remote transceiver 36.

It is understood that the connection between the data input 24 or data output 34 and the external components may be by way of a wireless connection. For instance, the external components may communicate with the data input 24 or data output 34 via Bluetooth® technology, or other short-range communication technology known by those skilled in the art.

It is contemplated that the remote transceiver 36 may relay the communication to a monitoring station, such as a central command station or other similar venue that monitors the activity of the wearer. Although FIG. 2 only shows one safety vest assembly 10 communicating with a remote transceiver 36, it is understood that several safety vest assemblies 10 may be in communication with a single remote transceiver 36. For instance, a team of police officers, fire fighters, and/or soldiers may be in communication with a single remote transceiver 36. This may be particularly beneficial in coordinating large-scale emergency response efforts among several emergency response teams.

The safety vest assembly 10 may include a signal alarm for alerting the user when communication between the data output 34 and the remote transceiver 36 is lost. For instance, it is contemplated that communication between the data output 34 and the remote transceiver 36 will be short-range communication. Therefore, the signal alarm alerts the user when the user has traversed beyond the communication range between the data output 34 and the remote transceiver 36. The signal alarm may transmit an audio signal or a visual signal (e.g., a light) for alerting the user of the loss of communication.

It may be desirable to encrypt the data before it is communicated to the remote transceiver 36. For instance, various military applications may require encryption to mitigate reception of the communication by enemy forces. To this end, an encryption device 48 may be in electrical communication with the data output 34 to encode the data before it is communicated to the remote transceiver 36.

Figure 2:
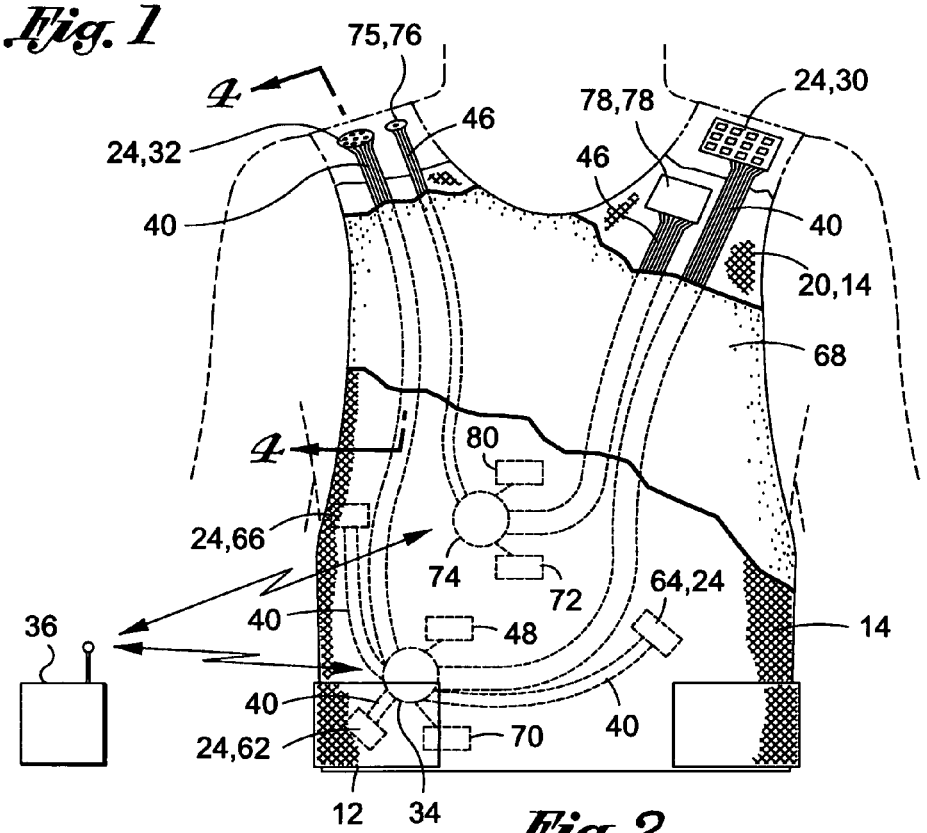
FIG. 2 is a cutaway plan view showing the inner layers of the safety vest assembly illustrated in FIG. 1.

According to one embodiment, communication between the data input 24 and data output 34 is achieved by way of an input flex circuit 40, as best illustrated in FIG. 2. The input flex circuit 40 is connectable to both the data input 24 and the data output 34 to communicate data therebetween. The input flex circuit 40 is integrated into the vest 12 and provides a flexible, yet durable communication pathway between the data input 24 and data output 34.

According to one embodiment, the input flex circuit 40 includes a plurality of conductive strips 52 arranged in fixed, parallel, spaced apart relationship with each other. Each of the respective conductive strips 52 terminates in a flex contact pad 53 located at a circuit connection portion 42. Each flex contact pad 53 may include an outwardly projecting circuit connection protrusion for facilitating engagement with an external electrical component, such as the data input 24 or data output 34. The flex circuit 40 may also include an insulative covering layer 54 to electrically insulate the plurality of conductive strips 52. The covering layer 54 may include a plurality of apertures through which the circuit connection protrusions extend through. In one embodiment, the insulative covering layer 54 is constructed out of a suitable insulating material, such as plastic or plastic-like material, and is transparent or translucent so as to expose the plurality of conductive strips 52 for visual observation and view.

Figure 3:
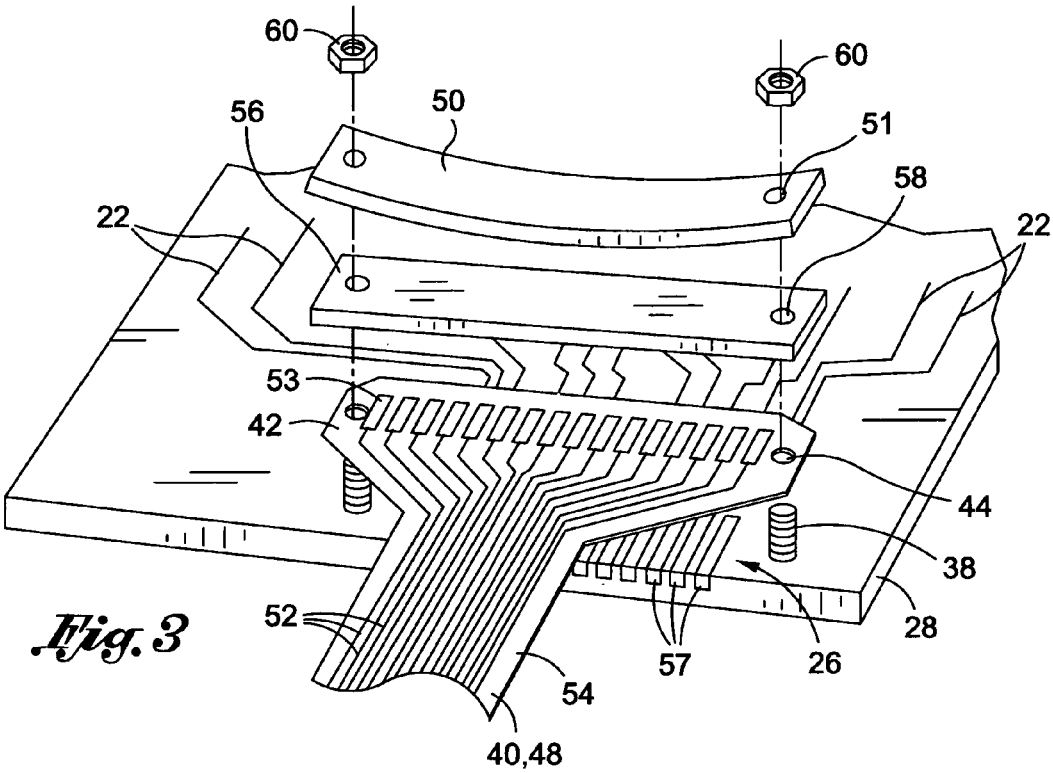
FIG. 3 is a exploded view showing engagement between the flex circuit and a data port.
Figure 4:
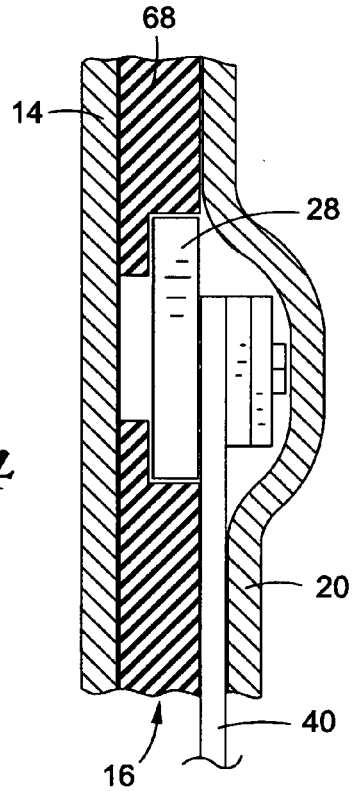
FIG. 4 is a partial side sectional view of safety vest assembly illustrated in FIG. 2.

According to various aspects of the present invention, and referring now to FIG. 3, the data input 24 and data output 34 are connected to a respective contact substrate 28. The contact substrate 28 may include a printed circuit board, or other planar surface. Each contact substrate 28 includes an input connection element 26 for engagement with the input flex circuit 40. As shown, the input connection element 26 includes a plurality of substrate contact pads 57 aligned in a parallel array. The plurality of substrate contact pads 57 are in electrical communication with the data input 24 or data output 34 connected to the contact substrate 28. In the specific embodiment shown in FIG. 3, each substrate contact pad 57 is connected to a substrate lead 22, which is connected to the data input 24 or data output 34. It is contemplated that the flex contact pads 53 mate with, and are in alignment with, the plurality of substrate contact pads 57 to facilitate communication between the data input 24 or data output 34 and the flex circuit 40. In this manner, the spacing between adjacent ones of the substrate contact pads 57 may correspond to the spacing between adjacent ones of the flex contact pads 53.

The engagement between the substrate contact pads 57 and the flex contact pads 53 may be achieve solely by pressure. In this manner, solder may not be required to engage the input flex circuit 40 with the contact substrate 28. Rather, the input flex circuit 40 may simply be pressed against the contact substrate 28 for engagement therewith. In the particular embodiment shown in FIG. 3, a pressure distribution element 56 is disposed between a biasing element 50 and the flex circuit 40. The biasing element 50 is configured to apply pressure to the pressure distribution element 56 which distributes the pressure to the input flex circuit 40. In this manner, the input flex circuit 40 engages with the contact substrate 28.

The contact substrate 28 may include a substrate alignment element 38 to assist alignment between the substrate contact pads 57 and the flex contact pads 53. Likewise, the input flex circuit 40 may include a flex alignment element 44 being engageable with the substrate alignment element 38 for properly aligning the input flex circuit 40 with the contact substrate 28. In the particular embodiment depicted in FIG. 3, the substrate alignment element 38 includes a pair of threaded posts, while the flex alignment element 44 includes a pair of holes. The posts may be received within the holes to align the substrate contact pads 57 with the flex contact pads 53. A securement element 60 may be engaged with the substrate alignment element 38 to secure the flex circuit 40 to the contact substrate 28. In addition, the pressure distribution element 56 and biasing element 50 includes a pressure distribution alignment element 58 and a biasing alignment element 51, respectively, for alignment with the flex circuit 40.

In another embodiment of the present invention, the substrate contact pads 57 are not flat as previously described and illustrated. Rather, the substrate contact pads 57 are raised and include a shaped receptacle or recess for insertably receiving the flex contact pad 53. The raised substrate contact pads 57 may be frusto-conical in configuration and the recess shape may also be conical so as to be conformal therewith. Conformance in the shape aids in alignment and insertion during assembly and also insures a tight fit without gaps or spaces which might otherwise permit looseness and unwanted disconnection or separation.

As previously mentioned, several embodiments include engagement between the input flex circuit 40 and the data input 24 and data output 34 independent of a soldered joint. Soldering typically increases the assembly cost and is very labor intensive. In addition, a soldered connection is liable to disconnect or separate when subject to multiple temperature changes, or shock and vibration. Furthermore, the interconnection of the present invention may allow for easier disassembly which may be desirable for purposes of replacement.

For a more detailed description of the connection between the input flex circuit 40 and the contact substrate 28, refer to U.S. Pat. No. 6,739,878 entitled Pressure Point Contact for Flexible Cable, issued to Balzano, the contents of which are expressly incorporated herein by reference.

The above-described safety vest assembly 10 includes a communication system for enabling one-way communication between the wearer and the remote transceiver 36. However, other implementations of the invention are directed toward facilitating communication from the remote transceiver 36 to the safety vest assembly 10. To this end, the safety vest assembly 10 may include a receiver 74 for receiving communications from the remote transceiver 36. The receiver 74 communicates the received communications to a receiver output element 75 connected to the vest 12, such as a speaker 76, display 78 or other means for broadcasting the message to the wearer. The receiver output element 75 may be surface mounted to the exterior of the vest 12. Alternatively, the receiver output element 75 may be connectable to an external output component, such as an earpiece, for communicating the data to the user. For instance, a soldier may include earphones integrated into his helmet. As such, the earphones may be connected to the receiver output element 75 to transmit the data to the wearer. Such a connection may employ a wire, or wireless technology.

Communications may be transferred between the receiver 74 and the receiver output element 75 by way of a receiver flex circuit 46. In this manner, the receiver output elements 75 may be connected to a contact substrate 28 for engagement with the receiver flex circuit 46, as described in more detail above. In this regard, two-way communication between the wearer and the remote transceiver 36 may be achieved. Furthermore, communication between two different wearers may also be attained.

As previously mentioned, it may be desirable to communicate encoded signals between the safety vest assembly 10 and the remote transceiver 36. Therefore, communications received by the safety vest assembly 10 may be encoded. As such, one embodiment includes a decryption device 80 for decryption data received by the safety vest assembly 10 from the remote transceiver 36.

One embodiment of the present invention includes an internal power supply disposed within the vest cavity 16 for supplying power to the various components contained within the vest 12. In this manner, the power supply may be in electrical communication with the data input 24, data output 34, receiver 74, and/or receiver output element 75. The safety vest assembly 12 may also include a power port being connectable to an external power supply. In this manner, should the internal power supply fail, the user may connect the power port to an external power supply.

According to various aspects of the present invention, the safety vest assembly 10 may include various types of protective gear that may be worn by a wearer. For instance, the vest 12 may include a bullet resistant vest worn by an individual who is located in a hostile environment. This may include a police officer, soldier, medical personnel, or media members. The bullet resistant vest includes a bullet protection layer 68 disposed within the vest cavity 16. The bullet protection layer 68 is configured to mitigate bullet penetration through the vest 12. The bullet protection layer 68 may be constructed out of Kevlar® or other bullet resistant materials known by those skilled in the art.

According to one embodiment, the flex circuit 40, 46 is folded or contoured into the inner layers of the bullet resistant vest so as to preserve signal integrity and to secure high reliability. It may be desirable to dispose the flex circuit 40, 46 behind the bullet protection layer 68 in order to protect the flex circuit 40, 46. In this manner, the vest 12 may include a vest inner portion 20 that is disposable adjacent a wearer. The flex circuit 40, 46 is disposed between the bullet protection layer 68 and the vest inner portion 20. Therefore, the bullet protection layer 68 also protects the flex circuit 40, 46 from being damaged by oncoming bullets. However, it is understood that the flex circuit 40, 46 may be disposed on the outside of the bullet protection layer 68 without departing from the spirit and scope of the present invention.

The safety vest assembly 10 may additionally include a vest 12 comprised of fire resistant material. In this manner, those who are exposed to the threat of fire may employ the use of the safety vest assembly 10 to enable integrated communication into a piece of protective clothing.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A safety vest assembly fitted for use by a wearer, the safety vest assembly comprising:

an outer layer;

a bullet protection layer disposed within the vest adjacent the outer layer;

an inner portion disposed adjacent to the bullet protection layer;

a receiver disposed within the vest for receiving data from a first remote transceiver;

a pressure sensor disposed within the vest for detecting pressure applied to the vest and generating a pressure sensor output signal in response thereto, the pressure sensor output signal being generated independent of wearer input;

an encryption device disposed within the vest for encrypting the pressure sensor output signal;

a decryption device disposed within the vest for decrypting the data received by the receiver;

a data output disposed within the vest and operative to receive output signals from the encrypting device; and flex circuitry disposed within the vest, the flex circuitry including multiple conductive paths formed on a flexible contact substrate;

wherein the receiver communicates the data received from the first remote transceiver to the decryption device; and wherein the data output communicates data received from the encryption device and outputs encrypted data to a second remote transceiver.

2. The safety vest assembly of claim 1 wherein the vest further includes a physiological sensor, a GPS, a speaker, a microphone, a display and a keypad and the pressure sensor, the encryption device, the decryption device, the data output, the receiver, the physiological sensor, the GPS, the speaker, the microphone, the display and the keypad being distributed within the vest.

3. The safety vest assembly of claim 2 wherein the pressure sensor, the encryption device, the decryption device, the data output, the receiver, the physiological sensor, the GPS, the speaker, the microphone, the display and the keypad are all connected by flex circuitry to facilitate flexibility of the vest assembly.

4. The safety vest assembly of claim 1 wherein the bullet protection layer is configured to mitigate bullet penetration through the vest.

5. The safety vest assembly of claim 1 further including a vest inner portion, and wherein at least a portion of the flex circuitry is disposed between the bullet protection layer and the vest inner portion.

6. The safety vest assembly of claim 1 wherein at least the vest assembly outer layer is comprised of lire resistant material.

7. The safety vest assembly of claim 3 wherein the keypad is disposed substantially flush with the vest outer layer, the keypad being in electrical communication with the data output and the encryption device, the keypad being operative to facilitate manual entry of data.

8. The safety vest assembly of claim 7 wherein the microphone is disposed substantially flush with the vest outer layer, the microphone being in electrical communication with the data output and the encryption device, the microphone being operative to facilitate transmission of audio messages.

9. The safety vest assembly of claim 8 wherein the GPS device is in electrical communication with the data output and the encryption device, the GPS device being operative to generate a positioning signal independent of wearer input.

10. The safety vest assembly of claim 9 wherein the physiological sensor is in electrical communication with the data output and the encryption device, the physiological sensor being operative to monitor the wearer's body temperature and heart rate.

11. The safety vest assembly of claim 10 wherein speaker is disposed substantially flush with the vest outer layer, the speaker being in electrical communication with the receiver and the decryption device, and operative to broadcast a received audio signal.

12. The safety vest assembly of claim 11 wherein display is disposed substantially flush with the vest outer layer, the display being in electrical communication with the receiver and the decryption device, and operative to display a received signal.

13. The safety vest assembly of claim 3 wherein the flex circuit includes an insulative covering layer over the plurality of conductive strips.

14. The safety vest assembly of claim 3 wherein the data output is configured to transmit an RF signal.

15. The safety vest assembly of claim 3 wherein the data output is wirelessly communicable with a remote transceiver.

16. The safety vest assembly of claim 12 wherein the encryption device also encrypts data received from the physiological sensor, the GPS, the microphone, and the keypad.

* * * * *